US005946877A

United States Patent [19]

Gallinat et al.

[11] Patent Number: 5,946,877

[45] Date of Patent: Sep. 7, 1999

[54] COMPOSITE SHINGLE HAVING TARGET NAILING AREAS

[75] Inventors: Charles E. Gallinat, Santa Anna, Calif.; Andy Rudy, Upper Arlington, Ohio; Thomas K. Thompson, Granville, Ohio

[73] Assignee: Owens Corning Fiberglas Technology, Inc., Summit, Ill.

[21] Appl. No.: 09/067,551

[22] Filed: Apr. 28, 1998

[51] Int. Cl.[6] ..... E04D 1/24

[52] U.S. Cl. ..... 52/543; 52/533; 52/553; 52/521; 52/97

[58] Field of Search ..... 52/553, 533, 521, 52/97, 543, 546, 98

[56] References Cited

U.S. PATENT DOCUMENTS

| | | | |
|---|---|---|---|
| 511,385 | 12/1893 | White | 52/543 |
| 2,188,090 | 1/1940 | Young | 52/553 |
| 2,308,766 | 1/1943 | Martinus | 52/521 |
| 3,332,193 | 7/1967 | Elmendorf | 52/543 |
| 3,618,274 | 11/1971 | Vickerman | 52/543 |
| 4,001,997 | 1/1977 | Saltzman | 52/521 |
| 4,592,185 | 6/1986 | Lynch et al. | 52/543 |
| 4,765,113 | 8/1988 | Jong | 52/533 |
| 4,982,543 | 1/1991 | Boyd | 52/521 |
| 5,224,318 | 7/1993 | Kemerer | 52/521 |
| 5,295,339 | 3/1994 | Manner | 52/518 |
| 5,575,127 | 11/1996 | O'Neal | 52/520 |
| 5,615,523 | 4/1997 | Wells et al. . | |
| 5,711,126 | 1/1998 | Wells . | |
| 5,729,947 | 3/1998 | Dawes | 52/521 |
| 5,791,112 | 8/1998 | Plum | 52/551 |

*Primary Examiner*—Carl D. Friedman
*Assistant Examiner*—Phi Dieu Tran A
*Attorney, Agent, or Firm*—Inger H. Eckert

[57] ABSTRACT

A fastenable composite roofing shingle is made from a composition comprising an organic, resinous material and an inorganic filler material, the shingle having a structure comprising a top surface forming an upper, headlap portion and a lower, butt portion, with the headlap portion having one or more targets suitable for indicating a desired fastener location to a shingle installer. The targets include a recessed area in the top surface of the shingle to enable a head of a fastener to be sheltered below the top surface. The recessed area has a hollow dimple defining an area of additional indentation, whereby the thickness of the shingle in the recessed area is greater than the thickness of the shingle in the dimple.

21 Claims, 5 Drawing Sheets

COMPOSITE SHINGLE HAVING TARGET NAILING AREAS

TECHNICAL FIELD AND INDUSTRIAL APPLICABILITY OF THE INVENTION

This invention relates to shingles of the type suitable for providing an aesthetically pleasing appearance and a high degree of weatherability when applied to a building. More particularly, this invention relates to shingles comprised of organic, resinous material and an inorganic filler material.

BACKGROUND OF THE INVENTION

Conventional roof coverings for sloped roofs include asphalt shingles wooden shake shingles, sheet metal, slate, clay and concrete tile. Sheet metal, clay and slate are advantageous because of their high weatherability. Various parts of the world have local or regional architectural preferences for the appearance of the roof. In Europe, clay tile is generally preferred over the relatively flat looking asphalt shingle. Tastes in the U.S. vary, with the western and southwestern part of the U.S. preferring clay tile or wooden shake shingles instead of asphalt shingles.

One of the problems with clay tile and slate roofs is that the clay and slate tiles require significant labor to apply. The asphalt or wood shingles are nailable and are simply nailed to a roof deck in courses, usually from the bottom or cave to the top or ridge of the roof. Clay, concrete and slate tiles are heavier than asphalt shingles, and require more support to hold up the roof. Clay and slate tiles are inherently fragile, and suffer much breakage during shipping and installation. These materials are fragile even after installation on the roof, and can be damaged by foot traffic on the roof. Because of the breakage, high labor requirements, high material costs and extra support required for clay and slate tiles, the installed cost of clay and slate tiles greatly exceeds that of asphalt shingles.

Wooden shake shingles are generally flat boards, usually of cedar or other coniferous trees. The wooden shakes are nailed in courses on the roof deck, with the exposed or tab portions of the shingles of a subsequent course being laid over the headlap portions of the previous course of shingles. The shingles are cut so that the wood grain runs up the slope of the roof for an aesthetically pleasing appearance. The cutting of the wood, and the subsequent weathering of the shingles after installation on the roof create grooves and ridges running in the direction of the wood grain. A disadvantage of wooden shake shingles is that they absorb moisture and swell. Therefore, they must be applied in a spaced-apart arrangement to allow room for expansion. Because of the propensity of wooden shake shingles to absorb water, they tend to curl and not remain flat on the roof.

One of the desirable attributes of any roofing material is to be able to resist fires. This is particularly true in regions having a hot and dry climate, although fire resistance is desirable everywhere. A particularly important aspect of fire resistance is the ability of the roofing material to prevent a fire, or a similar source of heat such as a burning ember, from burning through the roofing material to thereby expose the roof deck or interior of the building to the fire. Metal roofs and clay and tile roofs have inherent advantages in fire resistance over wood shake shingle roofs. Asphalt shingles contain greater than 60 percent filler of finely ground inorganic particulate matter, such as limestone, and therefore are sufficiently fire resistant to obtain a Class A fire rating when measured by appropriate tests. Wooden shake shingles, even when treated with a fire retardant material, are not generally fire resistant and cannot achieve a Class A fire rating. Wooden shake shingles are particularly prone to failing the fire tests (absent fireproofing underlayments) because the shingles cannot be placed with side edges abutting, and the gaps between adjacent shingles contribute to the failure of the shake shingles to pass the fire tests.

Attempts have been made in the past to make cement, synthetic or plastic shingles or tiles to replicate the aesthetically pleasing look of wooden shake roof or tile roofs. Various experiments have been tried to make reinforced cement shingles or tiles. Weatherability, undesirable absorption of water, and long term stability of color can be a problem. Likewise, synthetic or plastic shingles or tiles have not been successful in replacing traditional roofing materials. The plastic material is generally too expensive in material costs, and traditional plastics do not weather well when exposed to sunlight in a roof application for extended periods of time. Further, some plastic materials lack fire resistant qualities.

A roof made from improved composite shingles of organic resinous material and mineral filler material is disclosed in U.S. Pat. No. 5,615,523 to Wells et al. The composite shingle is molded with integrally formed ribs on the underside for structural strength. This composite shingle has a headlap portion, and a tab portion that is normally exposed on the roof. Two nailing strips at the upper and lower ends of the headlap portion of the shingle contain ridges that serve as a nailing indicator for the roofer. Also, U.S. Pat. No. 5,711,126 to Wells discloses an angled composite roofing shingle suitable for use on hip and ridge roof portions, and having mating longitudinal edge surfaces to enable the shingle to cover and conform to the ridge line.

It would be desirable to have a composite shingle which would provide improved nailability over those shingles previously known. The ideal composite shingle would enable the shingle installer to nail the shingle to the roof while avoiding driving the nail through a rib, and without causing a substantial portion of the shingle to break off at the point where the nail is placed. A clean, secure nailing of the shingle to the roof is important to avoid potential sources of leaks and to provide good resistance to wind uplift. The ideal shingle would be easy to manufacture and would have an aesthetically pleasing appearance, such as the appearance of a wooden shake shingle or of a natural slate roof.

SUMMARY OF THE INVENTION

The above objects as well as other objects not specifically enumerated are achieved by a fastenable composite roofing shingle made from a composition comprising an organic, resinous material and an inorganic filler material, the shingle having a structure comprising a top surface forming an upper, headlap portion and a lower, butt portion, with the headlap portion having one or more targets suitable for indicating a desired fastener location to a shingle installer. The targets include a recessed area in the top surface of the shingle to enable a head of a fastener to be sheltered below the top surface. The recessed area has a hollow dimple defining an area of additional indentation, whereby the thickness of the shingle in the recessed area is greater than the thickness of the shingle in the dimple.

In another embodiment of the invention, a fastenable composite roofing shingle is made from a composition comprising an organic, resinous material and an inorganic filler material, and has a structure including a top surface forming an upper, headlap portion and a lower, butt portion, with the headlap portion having one or more targets suitable for indicating a desired fastener location to a shingle installer. The targets include a recessed area in the top surface of the shingle to enable a head of a fastener to be sheltered below the top surface. The shingle has a cavity under the top surface, the cavity being defined by an underside of the top surface, a first side surface extending downward from the top surface, a second side surface extending downward from the top surface, an upper end surface extending downward from the top surface, and a butt end surface extending downward from the top surface. The shingle has a target locus on the underside of the top surface in alignment with the recessed area in the top surface, with the target locus having an outline corresponding to the shape of the recessed area in the top surface. A plurality of ribs is positioned within the cavity, extending downward from the top surface. The ribs extend generally along the direction from the butt end surface to the upper end surface. One of the ribs extends generally along a line crossing the target locus, but is curved at the target locus to follow the outline of the target locus rather than cross the target locus.

In yet another embodiment of the invention, a fastenable composite roofing shingle is made from a composition comprising an organic, resinous material and an inorganic filler material. The shingle has a structure comprising a top surface forming an upper, headlap portion and a lower, butt portion, with the headlap portion having one or more targets suitable for indicating a desired fastener location to a shingle installer. The targets include a recessed area in the top surface of the shingle to enable a head of a fastener to be sheltered below the top surface, and further include a drip channel positioned at a lower, butt side of the recessed area to enable water to drain from the recessed area, where the drip channel is recessed from the top surface of the shingle.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

The invention will be described with reference to roofing shingles that are similar in appearance to slate tiles suitable for making a natural slate roof. It is to be understood, however, that the terms "shingles" and "roofing shingles" also include shingles, tiles and panels, and the shingles, tiles and panels can have appearances other than natural slate, such as, for example, wood shake panels or tiles and mission tiles.

Figure 1:
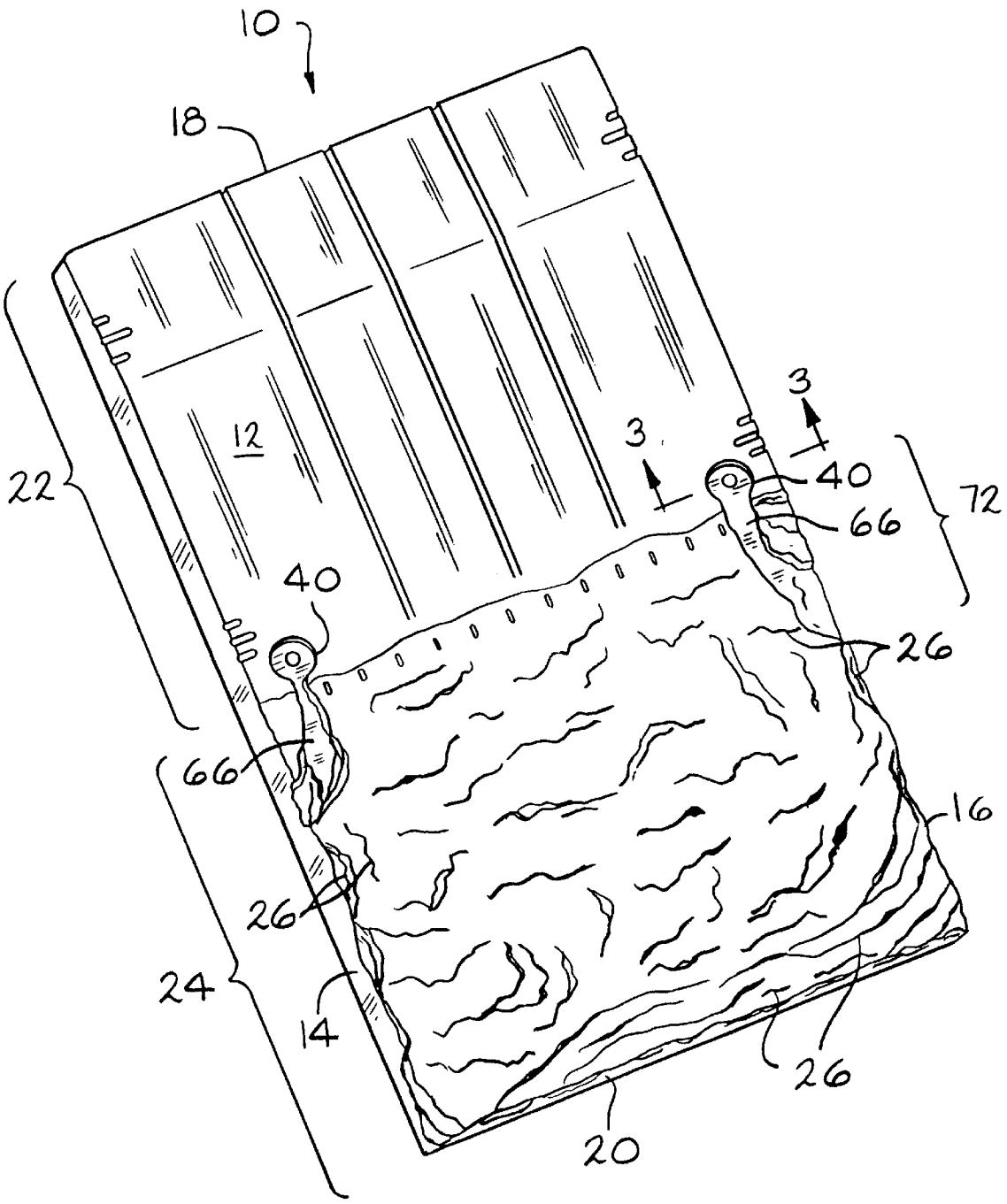
FIG. 1 is a schematic perspective view of a fastenable composite roofing shingle of the invention, having a design with the appearance of a natural slate roof.
Figure 2:
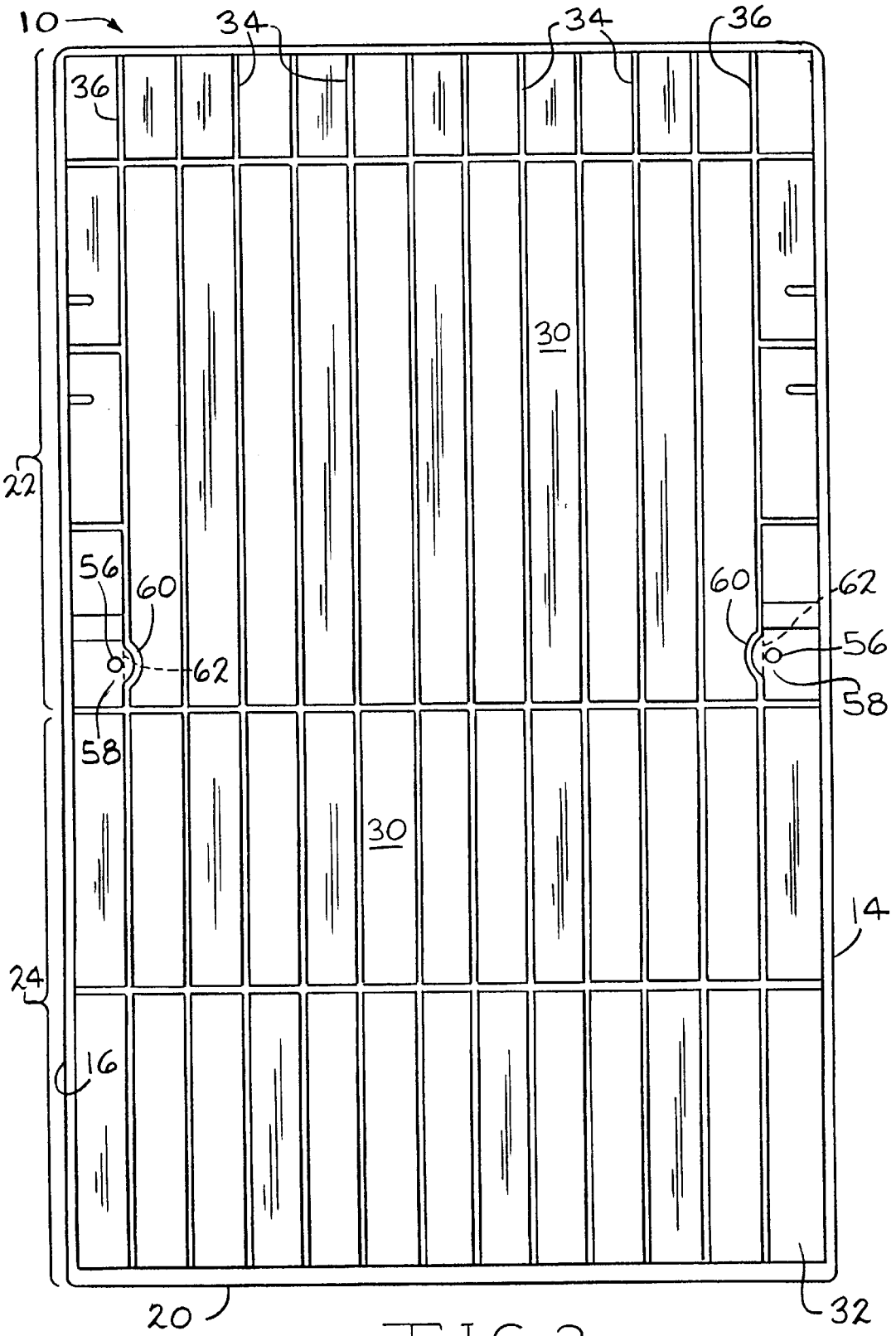
FIG. 2 is a schematic plan of the underside of the shingle illustrated in FIG. 1.

As shown in FIGS. 1 and 2, the shingle 10 has a top surface 12, first side surface 14, second side surface 16, upper end surface 18 and lower or butt end surface 20. The first side surface 14, second side surface 16, upper end surface 18 and lower or butt end surface 20 all extend downward from the top surface, and are generally perpendicular to the top surface. The top surface of the shingle can be divided into an upper or headlap portion 22 and a lower or butt portion 24. In normal application of the shingles on a roof, the headlap portion 22 of each shingle is covered by the exposed or butt portion 24 of the next course of shingles. As shown, the butt portion 24 of the shingle has a multiplicity of scale-like cracks or relief lines 26 indicating the vertical thickness variations common in natural slate material. The scale-like relief lines 26 are also present in the butt end surface 24 and in the butt portion of the first and second side surfaces 14, 16. The relief lines 26 simulate natural slate, and greatly enhance the aesthetic appearance of the shingle when installed as a complete roof covering.

The underside of the top surface 12 is indicated in FIG. 2 at 30. The underside 30, the first and second side surfaces 14, 16, the upper end surface 18 and the butt end surface 20 define a shingle cavity 32. A plurality of ribs, indicated generally at 34, is molded into the cavity to strengthen the shingle. The ribs extend downwardly from the top surface 12, in a similar manner as that of the side surfaces 14, 16, upper end surface 18 and lower or butt end surface 20. The ribs are preferably molded integrally with the top surface 12. Preferably the ribs are made to extend downwardly into the cavity 32 to the extent that the bottom edge of the ribs lies in a common plane with the bottom edges of the side surfaces, the upper end surface and the butt end surface. The effect of this coincidence of edges in a common plane is that the ribs can support the top surface of the shingle. The ribs can be of any design, but are conveniently arranged generally parallel to the side surfaces 14, 16 of the shingle, i.e., generally along the direction from the butt end surface 20 to the upper end surface 18. One of the purposes of the ribs, in addition to supporting the top surface of the shingle, is to provide integrity to the shingle so that when fastened to the roof with nails or other fasteners, the shingle will not split or tear away from the nails. Another purpose of the ribs is to provide sufficient flexural strength and rigidity required for the product with efficient use of material. The outermost ribs, i.e., those closest to the side surfaces 14, 16, are indicated at 36.

Referring again to FIG. 1, the top surface 12 of the shingle contains nailing targets 40 to help guide the shingle installer in finding the optimum location for the nails or other fasteners. The targets are generally comprised of a recessed area 42, as shown in more detail in FIG. 3. The recessed area 42 can be of any suitable shape, but is preferably circular in shape for optimum value as a target for the shingle installer. The recessed area should have a depth 43 sufficient to shelter the head of a fastener or nail, not shown, below the top surface 12 of the shingle, so that an overlying shingle will not rest on the head of the nail. A preferred diameter for the recessed area 42 is within the range of from about 0.375 to about 0.75 inches, and a preferred depth 43 for the recessed area is within the range of from about 0.040 to about 0.080 inches, although other diameters and depths can be used.

The recessed area 42 has a hollow dimple 44 defining an area of additional indentation in the bottom surface 46 of the recessed area. The dimple 44 can be of any shape suitable for acting as a target for the shingle installer, but is preferably of a hollow conical shape, as shown. The angle 48 for the slope of the dimple walls 50 is most preferably about 21 degrees with respect to the bottom surface 46. A preferred range of the angle 48 is about 15 to about 45 degrees, although any suitable angle can be used. At the top edge of the dimple, in the place of the recessed area bottom surface 46, the dimple preferably is circular, having a diameter within the range of from about 0.10 to about 0.30 inches. The dimple preferably has a depth within the range of from about 0.020 to about 0.10 inches, although other depths can be used. The use of a dimple 44 in the recessed area 42 results in a shingle where the thickness of the shingle in the recessed area is greater than the thickness of the shingle in the dimple. Preferably, the ratio of the thickness of the shingle in the recessed area to the thickness of the shingle in the dimple is within the range of from about 2:1 to about 4:1.

Figure 3:
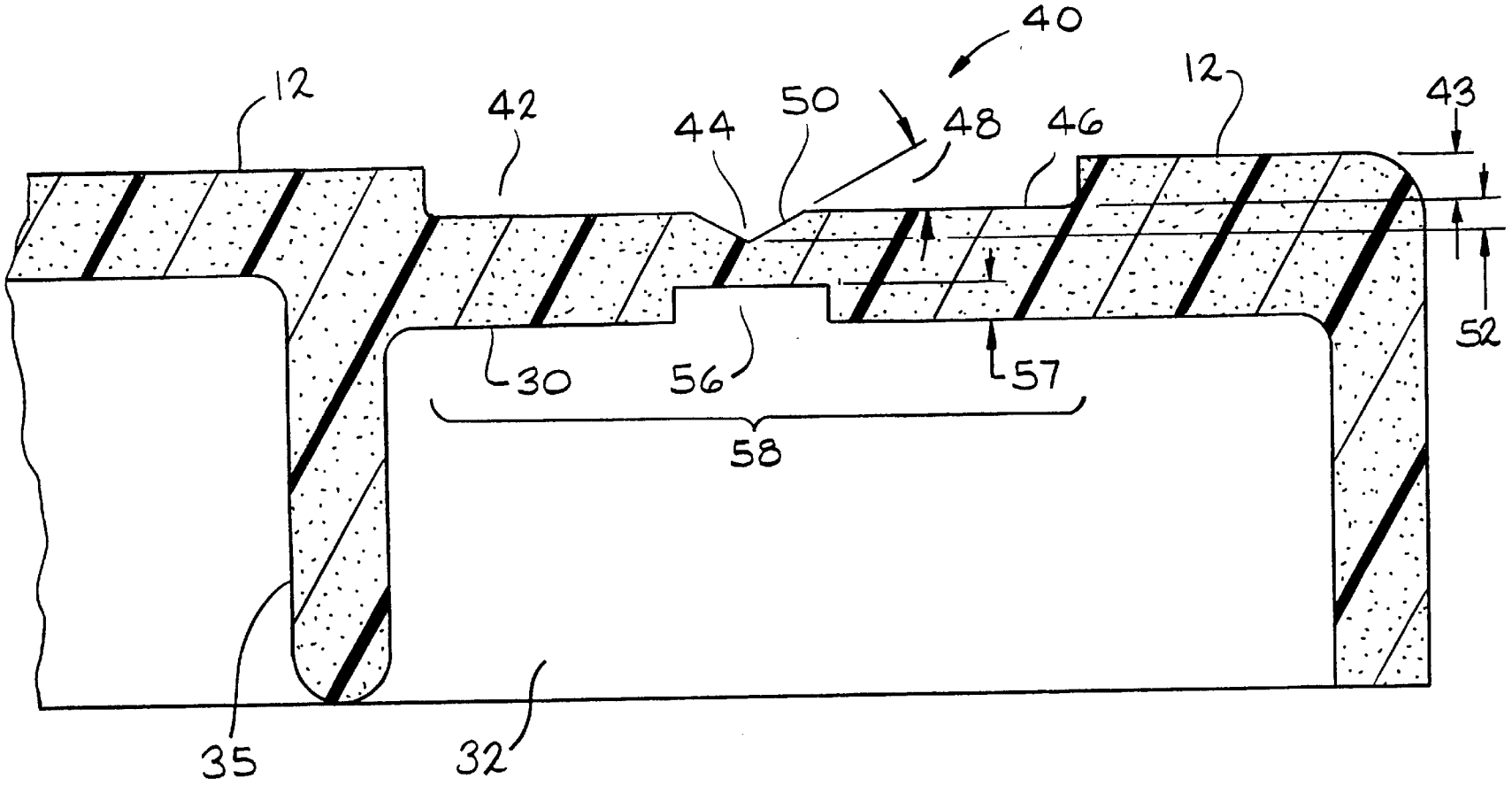
FIG. 3 is a schematic cross-sectional view of a section through a nailing target on the shingle, taken along line 3—3 of FIG. 1.

As also shown in FIG. 3 the underside 30 of the top surface 12 can be viewed as having a depression 56 defining an area of indentation. The depression is aligned with the hollow dimple 44 of the recessed area to further reduce the thickness of the shingle in the dimple with respect to the thickness of the shingle in the recessed area. Preferably the depression is circular, although other shapes can be used. Also, preferably, the depression has a diameter within the range of from about 0.10 to about 0.30 inches, and a depth 57 within the range of from about 0.020 to about 0.060 inches.

The effect of the depression is to make it easier for the nail or other fastener to penetrate the shingle in the target area. More importantly, the depression helps control the fragmenting of the underside 30 of the top surface as the nail is driven through the shingle. Without the depression, the explosive force of the nail entering the composite material can shatter a significant portion of the underside of the shingle, and sometimes this results in a nail hole so large that the hole is larger than the head of the nail. This undesirable result has the consequence of a shingle that is not securely fastened to the roof deck, thereby allowing the shingle to be subject to wind uplift problems and other problems. The presence of the depression 56 helps contain the shattering of the underside of shingle to a localized area. Accordingly, it can be seen that the use of the depression in the underside of the shingle helps prevent the accidental creation of nail holes that are too large.

The underside 30 of the top surface of the shingle has an area generally corresponding to the shape of the recessed area 42. This area is referred to as the target locus, and is indicated in FIG. 3 at 58. The target locus 58 is positioned directly beneath the target area, i.e., vertically aligned with the target 40. The target locus has an outline corresponding to the shape of the recessed area 42 of the target in the top surface, and is therefore preferably circular, although other shapes can be used. The target locus has no function other than to indicate, on the underside surface 30, the position of the target 40 on the top surface 12. As shown in FIG. 2, on the underside of the shingle the target locus 58 is positioned between the outermost ribs 36 and the first and second side surfaces, 14, 16, respectively. The outermost ribs 36 are provided with curved portions 60 so that the outermost ribs will follow the outline of the target locus 58 rather than cross the target locus. Absent the curved portions 60 in the outermost ribs 36, the outermost ribs would be straight and would follow a line (indicated at 62 as a phantom line) that would cross a portion of the target locus, and hence the outermost ribs would be positioned directly beneath a portion of the recessed area 42 of the target 40. Since it is highly desirable to avoid driving a nail into a rib, it is imperative that there be no rib positioned beneath the target. Therefore, the outermost ribs 36 are provided with the curved portions 62 so that the ribs follow the outline of the target locus. This is an equivalent to following the outline of the nailing target itself. Consequently, the ribs are not positioned to cross the target locus, and are not aligned directly beneath the target 40.

As shown in FIG. 1 the top surface 12 is provided with drip channels 66 to enable water to flow out from the recessed areas of the targets 40. Without the drip channels there is a possibility that water could be retained in the recessed area 42. This retained water could possibly freeze and cause damage to the surrounding material. Also, the retained water could possibly work its way down along the nail, not shown, and through the nail opening in the shingle and into the building supporting the roof. As shown, the drip channel 66 is positioned on the lower or butt side of the recessed area 42 of the nailing targets 40. When the shingle is installed on a roof of the building, the shingle slopes downward from the upper end surface 18 to the lower or butt end surface 20. The drip channels are recessed into the top surface 12 of the shingle, and are molded into the shingle in a configuration that directs or drains the water along the top surface 12 of the shingle. For many shingle configurations, the water then flows along the length of the butt portion 24 toward the butt end 20.

Although two nailing targets and drip channels are shown, it is to be understood that the shingle can be provided with just one nailing target or any other number of nailing targets. Further, the drip channels are optional, and can be provided for none, some, or all of the nailing targets.

Figure 4:
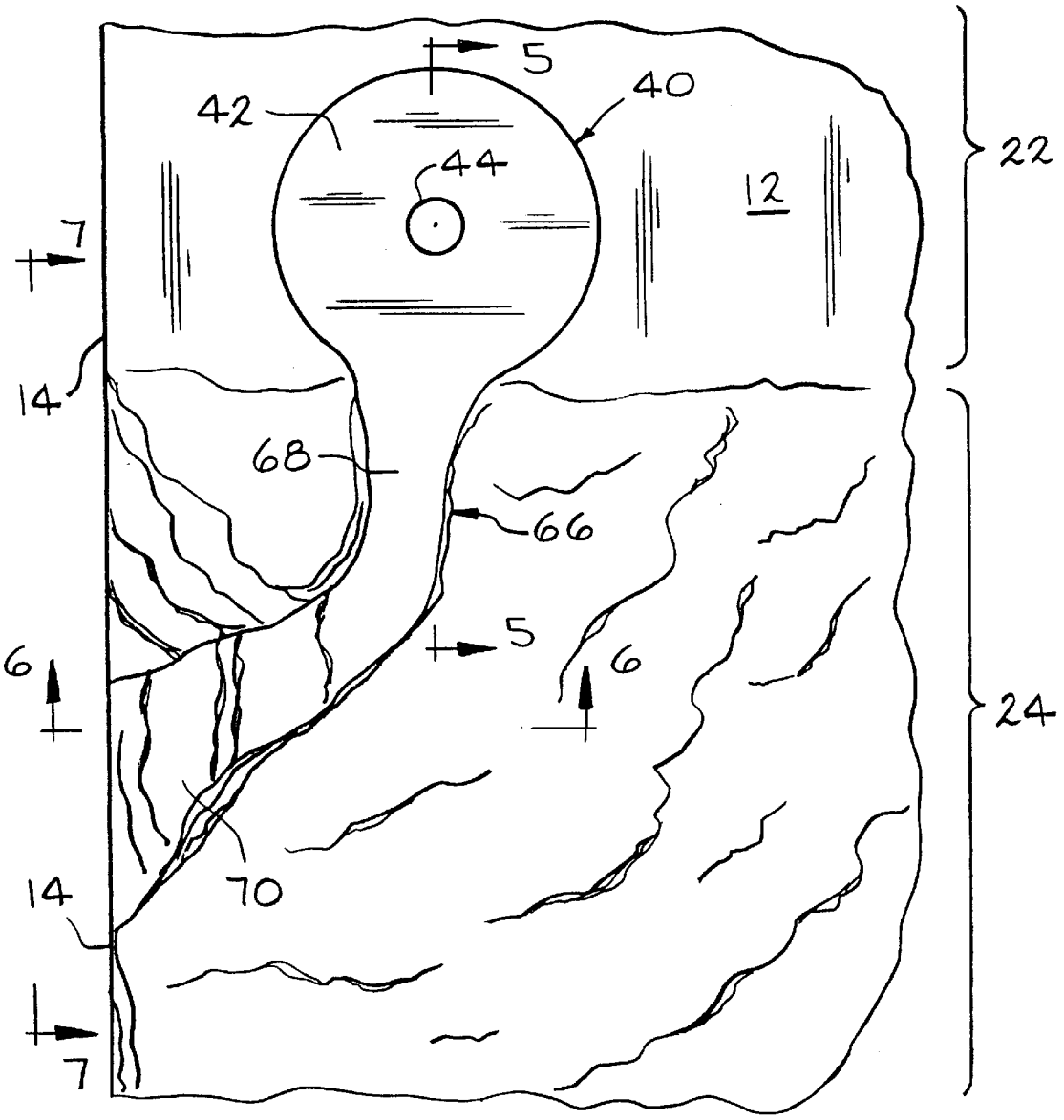
FIG. 4 is schematic plan view illustrating greater detail of a portion the target and shingle of FIG. 1.

Optionally, the drip channels can be configured as shown in FIGS. 1 and 4 so that the water is directed to the side surfaces 14, 16 of the shingle. In such a case, the lower end 70 of the drip channel extends to or intersects the side surface 14 at the upper end 72 of the butt portion 24 of the shingle, as shown in FIG. 1. As shown in FIGS. 4–7 the drip channel 66 has an upper end 68 contacting the lower or butt side of the recessed area 42, and a lower end 70 opening out to the first side surface 14, thereby defining a flow path for water from the nailing target to the first side surface 14. As seen particularly in FIG. 5, the upper end 68 of the drip channel is recessed from the top surface 12 of the shingle by an amount substantially equal to the amount of recess of the recessed area 42.

Figure 8:
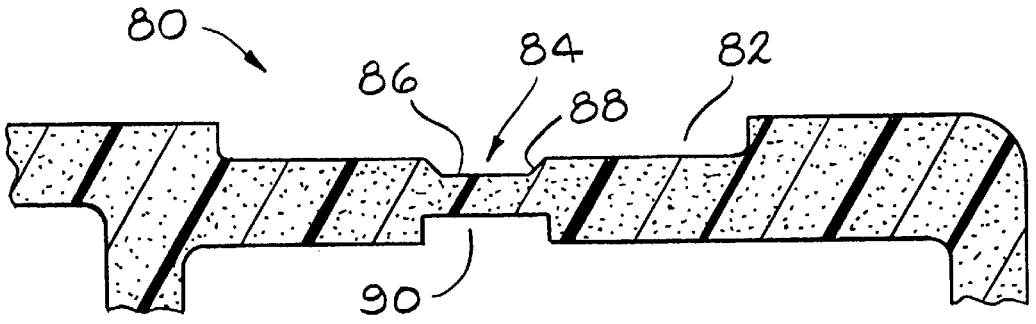
FIG. 8 is a partial schematic cross-sectional view, similar to the view shown in FIG. 3, of another embodiment of a nailing target of the invention.
Figure 5:
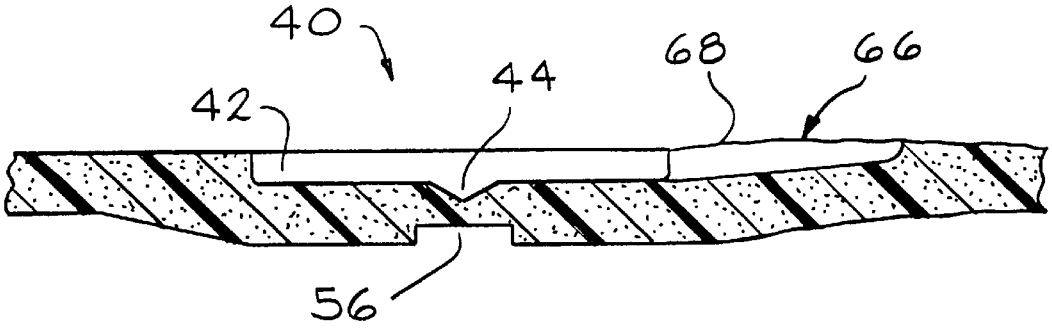
FIG. 5 is a cross-sectional view of the target taken along line 5—5 of FIG. 4.
Figure 6:
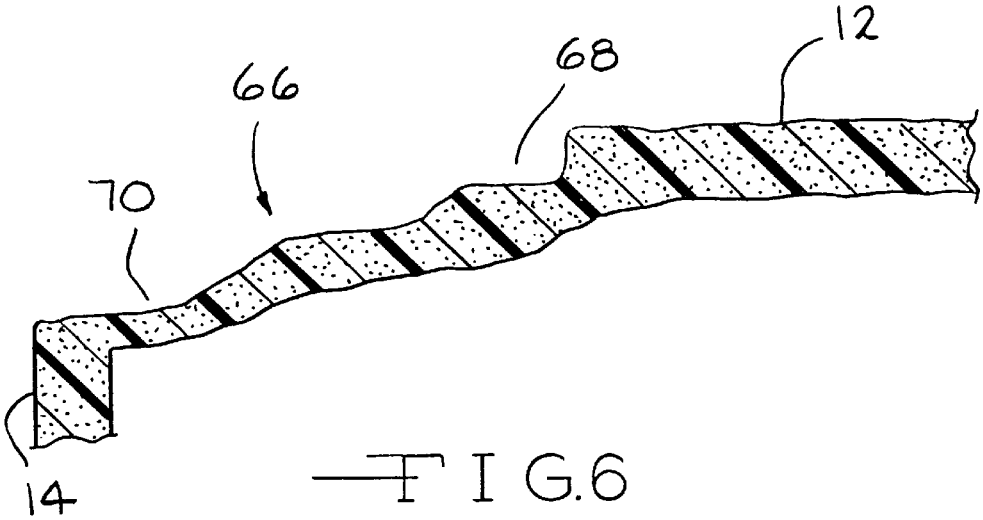
FIG. 6 is a cross-sectional view of the shingle taken along line 6—6 of FIG. 4.
Figure 7:
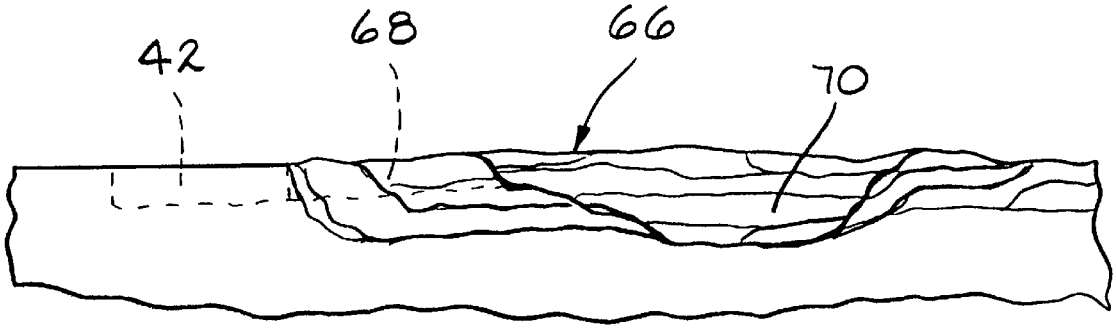
FIG. 7 is an elevational view of the shingle taken along line 7—7 of FIG. 4.

As can be seen in the alternate configuration of the nailing target illustrated in FIG. 8, the nailing target 80 is provided with a recessed area 82 and a dimple 84 that is not conical in shape, but rather is provided with a relatively flat bottom 86 and sloped walls 88. The angle of the sloped walls is preferably within the range of from about 15 to about 45 degrees with respect to the bottom 86, although any suitable angle can be used. As shown, the width of the dimple 84 is approximately the same as the width of the depression 90 on the underside of the shingle.

The principle and mode of operation of this invention have been described in its preferred embodiments. However, it should be noted that this invention may be practiced otherwise than as specifically illustrated and described without departing from its scope.

What is claimed is:

1. A fastenable composite roofing shingle made from a composition comprising an organic, resinous material and an inorganic filler material, the shingle having a structure comprising a top surface forming an upper, headlap portion and a lower, butt portion, with the headlap portion having one or more targets suitable for indicating a desired fastener location to a shingle installer, the targets including a recessed area in the top surface of the shingle to enable a head of a fastener to be sheltered below the top surface, and a depression in an underside of the top surface defining an area of indentation, whereby the depression is aligned with the recessed area of the top surface to further reduce the thickness of the shingle in the recessed area.

2. The roofing shingle of claim 1 in which the dimple has a hollow conical shape.

3. The roofing shingle of claim 1 in which the dimple has sloped walls and a flat bottom.

4. The roofing shingle of claim 1 in which the ratio of the thickness of the shingle in the recessed area to the thickness of the shingle in the dimple is within the range of from about 2:1 to about 4:1.

5. The roofing shingle of claim 1 in which the dimple is generally circular and has a diameter within the range of from about 0.10 to about 0.30 inches.

6. The roofing shingle of claim 1 in which the dimple has a depth within the range of from about 0.020 to about 0.10 inches.

7. The roofing shingle of claim 1 in which the shingle has a cavity under the top surface, the cavity being defined by the underside of the top surface, a first side surface extending downward from the top surface, a second side surface extending downward from the top surface, an upper end surface extending downward from the top surface, and a butt end surface extending downward from the top surface.

8. The roofing shingle of claim 1 in which the depression is generally circular and has a diameter within the range of from about 0.10 to about 0.30 inches.

9. The roofing shingle of claim 1 in which the depression has a depth within the range of from about 0.020 to about 0.060 inches.

10. The roofing shingle of claim 1 in which the shingle has a cavity under the top surface, the cavity being defined by the underside of the top surface, a first side surface extending downward from the top surface, a second side surface extending downward from the top surface, an upper end surface extending downward from the top surface, and a butt end surface extending downward from the top surface, and a target locus on the underside of the top surface in alignment with the recessed area in the top surface, the target locus having an outline corresponding to the shape of the recessed area in the top surface, and further including a plurality of ribs within the cavity and extending downward from the top surface, the ribs extending generally along the direction from the butt end surface to the upper end surface, where one of the ribs extends generally along a line crossing the target locus, but is curved at the target locus to follow the outline of the target locus rather than cross the target locus.

11. The roofing shingle of claim 10 further including a drip channel positioned at a lower, butt side of the recessed area to enable water to drain from the recessed area, where the drip channel is recessed from the top surface of the shingle.

12. The roofing shingle of claim 1 further including a drip channel positioned at a lower, butt side of the recessed area to enable water to drain from the recessed area, where the drip channel is recessed from the top surface of the shingle.

13. A fastenable composite roofing shingle made from a composition comprising an organic, resinous material and an inorganic filler material, the shingle having a structure comprising a top surface forming an upper, headlap portion and a lower, butt portion, with the headlap portion having one or more targets suitable for indicating a desired fastener location to a shingle installer, the targets including a recessed area in the top surface of the shingle to enable a head of a fastener to be sheltered below the top surface, and where the shingle has a cavity under the top surface, the cavity being defined by an underside of the top surface, a first side surface extending downward from the top surface, a second side surface extending downward from the top surface, an upper end surface extending downward from the top surface, and a butt end surface extending downward from the top surface, and the shingle having a target locus on the underside of the top surface in alignment with the recessed area in the top surface, the target locus having an outline corresponding to the shape of the recessed area in the top surface, and further including a plurality of ribs within the cavity and extending downward from the top surface, the ribs extending generally along the direction from the butt end surface to the upper end surface, where one of the ribs extends generally along a line crossing the target locus, but is curved at the target locus to follow the outline of the target locus rather than cross the target locus.

14. The roofing shingle of claim 13 in which the target locus is generally circular.

15. The roofing shingle of claim 13 where the ribs are generally parallel to the first and second side surfaces.

16. The roofing shingle of claim 15 in which the recessed area has a hollow dimple defining an area of additional indentation, whereby the thickness of the shingle in the recessed area is greater than the thickness of the shingle in the dimple.

17. A fastenable composite roofing shingle made from a composition comprising an organic, resinous material and an inorganic filler material, the shingle having a structure comprising a top surface forming an upper, headlap portion and a lower, butt portion, with the headlap portion having one or more targets suitable for indicating a desired fastener location to a shingle installer, the targets including a recessed area in the top surface of the shingle to enable a head of a fastener to be sheltered below the top surface, and further including a drip channel positioned at a lower, butt side of the recessed area to enable water to drain from the recessed area, where the drip channel is recessed from the top surface of the shingle, the drip channel has an upper end contacting the lower, butt side of the recessed area, and the drip channel has a lower end, where the upper end of the drip channel is recessed from the top surface of the shingle by an amount equal to the amount of recess of the recessed area.

18. The roofing shingle of claim 17 in which the shingle has first and second side surfaces, the drip channel has an upper end contacting the lower or butt side of the recessed area, and the drip channel has a lower end intersecting one of the side surfaces.

19. The shingle of claim 18 in which the drip channel intersects one of the side surfaces at an upper end of the butt portion of the shingle.

20. The roofing shingle of claim 17 further including a depression in an underside of the top surface defining an area of indentation, whereby the depression is aligned with the recessed area of the top surface to further reduce the thickness of the shingle in the recessed area.

21. The roofing shingle of claim 1 where the depression is aligned with the hollow dimple in the recessed area of the top surface to further reduce the thickness of the shingle in the dimple with respect to the thickness of the shingle in the recessed area.

* * * * *